US005533367A

United States Patent [19]

Lybarger et al.

[11] Patent Number: 5,533,367

[45] Date of Patent: Jul. 9, 1996

[54] APPLIANCE SHIPPING RESTRAINT ASSEMBLY

[75] Inventors: Michael A. Lybarger; Stephen D. Beck, both of Louisville, Ky.

[73] Assignee: General Electric Company, Louisville, Ky.

[21] Appl. No.: 427,890

[22] Filed: Apr. 26, 1995

[51] Int. Cl.[6] ..... D06F 35/00

[52] U.S. Cl. ..... 68/3.00 R

[58] Field of Search ..... 68/3 R; 206/320; 248/500

[56] References Cited

U.S. PATENT DOCUMENTS

| | | | |
|---|---|---|---|
| 3,249,215 | 5/1966 | Kelly | 68/3 R X |
| 3,798,931 | 3/1974 | Czech et al. | 68/3 R |
| 3,912,207 | 10/1975 | Gauer | 248/25 |
| 4,366,902 | 1/1983 | Fanson et al. | 206/320 |
| 4,624,117 | 11/1986 | Ory et al. | 68/3 R |
| 5,056,341 | 10/1991 | Mori et al. | 68/3 R |
| 5,083,845 | 1/1992 | Sparks et al. | 312/228 |

*Primary Examiner*—Philip R. Coe
*Attorney, Agent, or Firm*—H. Neil Houser

[57] ABSTRACT

An appliance shipping restraint assembly includes a housing with a base and vertical lateral walls. An operational assembly is mounted in the housing and is normally moveable relative to the housing. The operational assembly includes a platform spaced above the base with a pair of spaced apart, aligned openings. The base includes a pair of spaced apart openings aligned with the openings in the platform. An elongated rod extends through the openings in the platform and the base to restrain the operational assembly against excessive movement during shipment of the appliance. The rod is removable to release the operational assembly for normal movement relative to the housing.

8 Claims, 2 Drawing Sheets

APPLIANCE SHIPPING RESTRAINT ASSEMBLY

BACKGROUND OF THE INVENTION

This invention relates to appliances such a automatic clothes washing machines. Automatic washing machines typically have an operational assembly or system, often referred to as the moving system, which includes the various components for washing and rinsing fabrics placed in the machine. Typical major operational components include an imperforate tub to hold fluid, a perforate basket within the tub to hold the fabrics to be washed, an agitator to move the fabrics within the wash and rinse fluid, a pump to circulate and drain the fluid and a motor and transmission to operate the agitator and pump and to spin the basket. The operational assembly or system is mounted within a stationary housing and is moveable relative to the housing in order to be able to accommodate the forces generate during operation of the machine. Forces often exerted on the machine during shipment can cause excessive movement of the operational system, with attendant damage to the machine.

A number of approaches have been taken to prevent damage to the machine during shipment. However, none has been optimal.

It therefore is an object of this invention to provide an improved appliance shipping restraint assembly.

It is another object of this invention to provide such an improved assembly that involves a minimum number of parts.

It is still another object of the present invention to provide such an improved assembly that minimizes the use of dunnage and other throwaway materials.

It is yet another object to provide such an improved assembly that is easily connected and disconnected.

It is still another object of this invention to provide such an improved assembly that is reusable each time it is desired to ship a particular appliance.

SUMMARY OF THE INVENTION

An appliance shipping restraint assembly includes an appliance housing with a base and lateral walls. An operational assembly is mounted in the housing and is normally moveable relative to the housing. The operational assembly includes a platform spaced above the base. The platform includes a pair of spaced apart, downwardly projecting ears with aligned openings therein. The base includes a pair of spaced apart, upwardly projecting ears with openings therein aligned with the openings in the platform ears. An elongated rod is mounted in the openings in the platform and base ears for restraining the operational assembly from excessive movement relative to the housing. The rod is removable from the openings to release the operational assembly for normal movement relative to the housing.

DETAILED DESCRIPTION OF PREFERRED EMBODIMENT

Figure 1:
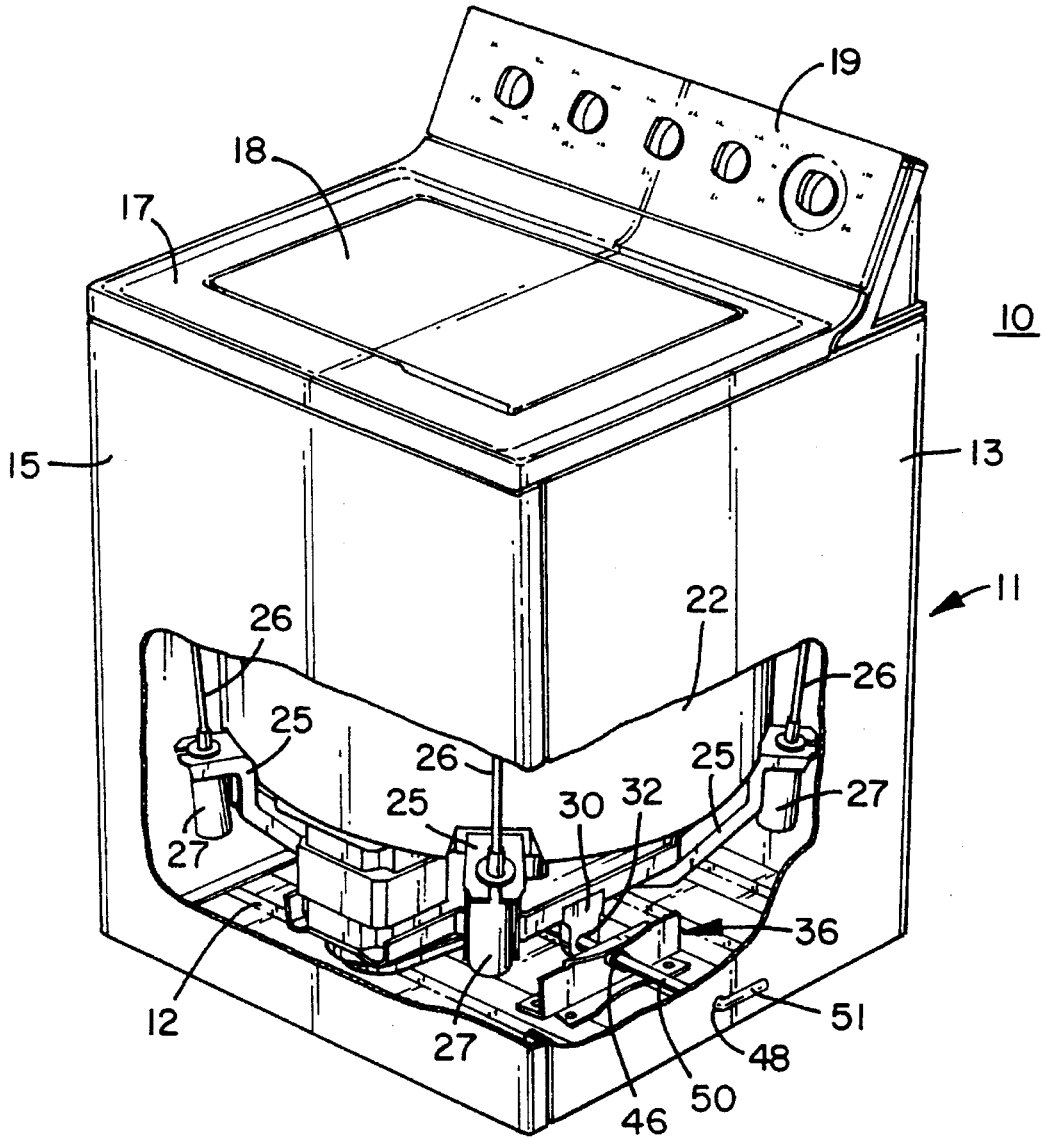
FIG. 1 is a perspective view of an automatic clothes washing machine incorporating one embodiment of the present invention, the view being partly broken away for purposes of illustration.

FIG. 1 illustrates an automatic clothes washing machine 10 of the vertical agitator type. The machine 10 includes a cabinet or housing 11 with a base 12 and lateral walls joined to and extending upward around the periphery of the base. In the illustrative machine, the base is rectangular and the lateral walls include spaced apart side walls 13,14 joined by a front wall 15 and a rear wall 16. The lateral walls 13–16 are formed by a number of panels which are mounted on the base 12 and connected together to form the box like housing. The tops of the walls 13–16 join a top wall 17. A door or lid 18 hinged to the top wall 17 provides the user with access to the inside of the machine. A control housing or backsplash 19 is mounted on the rear of the top wall 17 and contains various controls for use in controlling operation of the machine. The base 12 is a corrugated sheet of relatively heavy and stiff metal, such as sheet steel for example. However, it will be understood that the base can take various other forms, such as a grid work of members joined together in a frame. The base 12 is supported on a suitable floor by means of feet 20 which are vertically adjustable to level the housing even though the supporting floor is not level.

Figure 2:
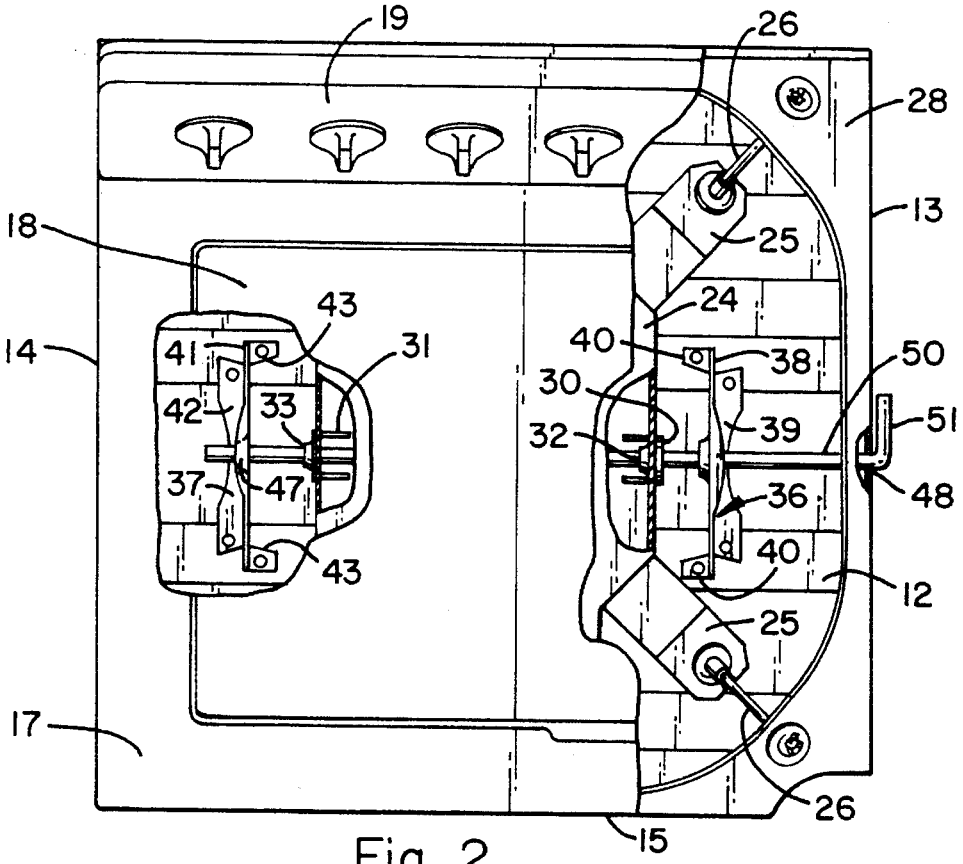
FIG. 2 is a plan view of the machine of FIG. 1, partly broken away and with some parts removed for purposes of illustration.

Referring now more particularly to FIGS. 1 and 2, the machine 10 has an operational assembly including a tub 22 and drive motor 23. Various other operational components, such as a basket to hold fabrics and an agitator are mounted inside the tub 22 and a pump (not shown) is mounted on the outside of the tub. The details of construction and connection of the various operational components is not part of the present invention and a detailed showing of them has been omitted for the sake of simplicity.

The operational assembly is mounted on a suspension system including a platform 24 on which various components, such as tub 22 and motor 23, are mounted. A foot 25 is firmly connected at each corner of the platform so that the feet are integral parts of the platform. Each foot 25 is connected to the lower end of a support arm 26 through a damping piston assembly 27. Each support arm 26 is mounted to a support collar 28 adjacent the corresponding top corner of housing 11. Conveniently the collar 28 extends around the top inside edge of the walls 13–16 and is attached to them. The support arms and piston assemblies permit the operational assembly normally to move relative to the housing while isolating the floor from vibrations of the operational assembly.

Essentially all automatic washing machines are shipped from the manufacturing site to the retail customer's home. In addition, many washing machines subsequently are shipped again whenever the owner moves. Such shipping subjects the washing machine to forces which tend to cause the operational system to move excessively relative to the housing. This can result in damage to various structural and operational components of the machine. A shipping restraint assembly includes a pair of ears 30,31 which are part of the platform 24 and project downward on diametrically opposite sides of the platform 24. The illustrative platform is formed from a suitable material, such as sheet steel, and the ears 30,31 are formed integrally with the platform. If desired, the ears 30,31 can be formed separately and permanently attached to the platform. The ears 30,31 are provided with openings 32,33 respectively therethrough. The opening 32,33 in each ear 30,31 respectively is aligned with the opening in the other ear so that the openings 32,33 are positioned on diametrically opposite sides of platform 24.

The base 12 includes a pair of upwardly projecting ears 36,37 which are aligned with the ears 30,31 respectively and are positioned outside the ears 30,31 (closer to side walls 13,14). Ear 36 includes a vertical web 38 with a horizontal flange 39 on one side and spaced apart horizontal feet 40 on the other side. The flange 39 and feet 40 are welded to the base 12 so that the ear 36 is integral with the base 12. Ear 37 is of a like construction with a vertical web 41, flange 42 and feet 43. The flange 42 and feet 43 are welded to the base 12. The ears 36,37 are provided with openings 46,47 respectively, therethrough. The openings 46,47 are aligned, front to back of machine 10, with the openings 32,33 in platform ears 30,31. An opening 48 is provided in side wall 13 in alignment with opening 46 in ear 36, and thus with opening 47 in ear 37 and front to back of the machine with openings 32,33 in ears 30,31. An elongated stiff rod 50 extends through openings 32,33; 46,47 and 48. The outer end 51 of rod 50 is positioned outside the housing 11 and is bent at a right angle to form a handle. The rod is inserted into the position shown in the Figs. during manufacture of the machine. The engagement of the rod 50 with ears 30,31 and ears 36,37 effectively connects the operational assembly to the base. The rod 50 is formed of a suitable material, like steel, so that it restrains the operational assembly from excessive movement relative to the housing 11 during shipment. When the machine is installed, the rod is removed through the opening 48 in side wall 13. This releases the operational assembly for normal movement relative to the housing 11, as controlled by the support arms 26 and damping piston assemblies 27.

Figure 3:
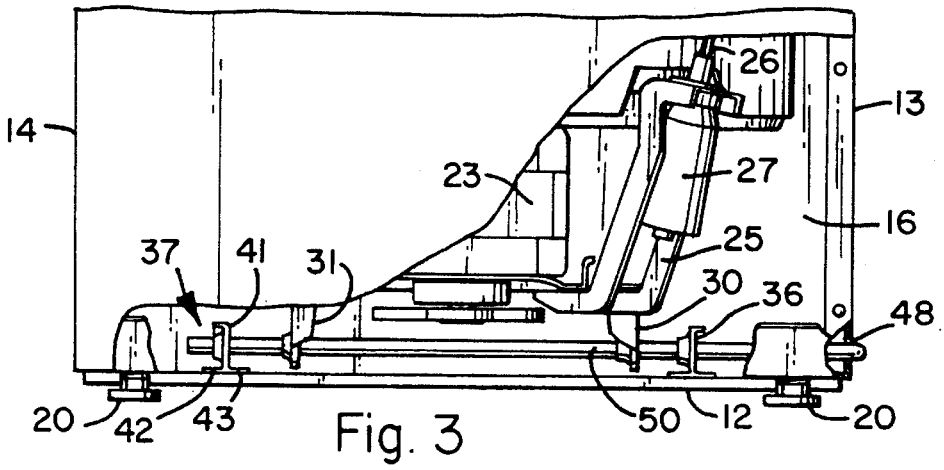
FIG. 3 is a fragmentary front elevation view of the machine of FIG. 1, partly broken away for purposes of illustration.
Figure 4:
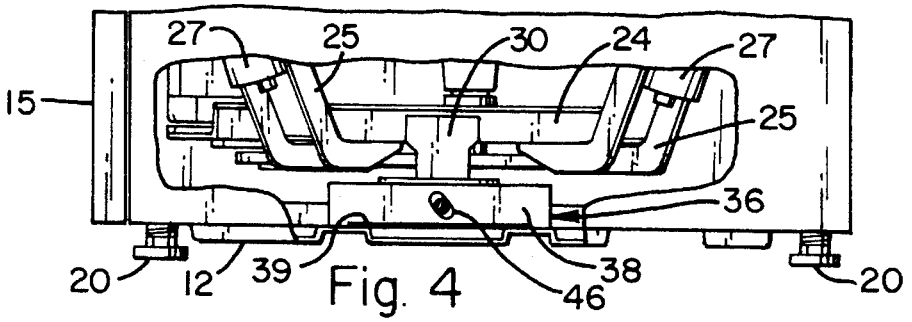
FIG. 4 is a fragmentary side elevation view of the machine of FIG. 1, partly broken away for purposes of illustration.

It will be seen from FIG. 3 that the bottom edges of platform ears 30,31 are very close to the base 12 when the ears 30,31 are connected to ears 36,37 by rod 50. This enables ears 36,37 to have a minimum height. However, if this was the position of ears 30,31 during operation of machine 10, normal movement of the operational assembly likely would cause the ears 30,31 to strike the base 12. Thus, it will be recognized that the operational assembly of the illustrative machine has a normal position higher than that shown. During manufacture of the machine 10, the operational assembly, including platform 24 and ears 30,31 is pushed downward against piston assemblies 27 to bring openings 32,33 into vertical alignment with openings 46,47 of ears 36,37 for insertion of the rod 50. If desired webs 38,41 can be made taller so that openings 46,47 and 48 can be aligned with the normal vertical position of openings 32,33.

The illustrative machine 10 includes only one rod 50 and associated openings in the platform and base. If desired more rod and opening arrangements can be provided. In the illustrative embodiment the rod 50 is removed and stored when the machine 10 is installed. The rod can be reinstalled if the machine is subsequently shipped. This arrangement simplifies installation, as the installer does not have to remove any panel or wall of the machine to release the operational assembly. If desired the opening 48 in a lateral wall can be eliminated by making the rod 50 shorter and orienting the shipping restraint assembly so that the rod can be removed by removing a lateral wall panel, preferably the panel that is removable for service of operational components. Furthermore one set of the openings 32,33 and 46,47 can be constructed with an upward open hook configuration and the rod 50 with an offset central section. With that construction the operational assembly can be released merely by appropriately rotating the rod.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. An appliance shipping restraint assembly, including;

an appliance housing having a base for support from a floor and lateral walls extending upward of said base;

an operational assembly mounted within said housing and normally moveable relative to said housing; said operational assembly including a platform spaced above said base and defining at least one pair of spaced apart, aligned openings;

said base defining at least one pair of spaced apart openings aligned with said at least one pair of platform openings; and at least one elongated rod mounted in said at least one pair of platform openings and said at least one pair of base openings for restraining said operating assembly against excessive movement during shipment of said appliance;

said at least one rod being selectively moveable to release said operational assembly for normal movement relative to said housing.

2. An appliance shipping restraint assembly as set forth in claim 1, wherein: said at least one rod is removable from said at least one pair of platform openings and said at least one pair of base openings to release said operational assembly.

3. An appliance assembly as set forth in claim 2, wherein:

one of said lateral walls defines at least one opening therein aligned with said at least one pair of platform openings and said at least one pair of base openings and said at least one rod extends through said at least one lateral wall opening when mounted in said at least one pair of platform openings and said at least one pair of base openings and is removable through said at least one lateral wall opening to release said operational assembly.

4. An appliance shipping restraint assembly, including:

an appliance housing having a base for support from a floor and lateral walls extending upward from said base;

an operational assembly mounted within and normally moveable relative to said housing; said operational assembly including a platform spaced above said base, said platform including a pair of spaced apart, downwardly projecting ears with aligned openings therein;

said base including a pair of spaced apart upwardly projecting ears with openings therein aligned with said openings in said platform ears;

an elongated rod mounted in said openings in said platform and base ears for restraining said operational assembly against excessive movement during shipment of said appliance;

said rod being movable to release said operational assembly for normal movement relative to said housing.

5. An appliance shipping restraint assembly as set forth in claim 4, wherein: said rod is removable from said openings in said platform and base ears to release said operational assembly.

6. An appliance assembly as set forth in claim 5, wherein:

one of said lateral walls defines an opening therein aligned with said openings in said platform ears and said base ears and said rod extends through said lateral wall opening when mounted in said openings in said platform and base ears and is removable through said lateral wall opening to release said operational assembly.

7. An appliance shipping restrain assembly, as set forth in claim 4, wherein:

said platform ears are positioned between said base ears.

8. An appliance shipping restraint assembly as set forth in claim 7, wherein: said openings in said platform ears normally are positioned above said openings in said base ears and said operational assembly is depressable to bring said platform ear openings into alignment with said base ear openings for insertion of said rod therethrough.

* * * * *